US005349894A

United States Patent [19]

Greer

[11] Patent Number: 5,349,894

[45] Date of Patent: Sep. 27, 1994

[54] LOCKING HYDRAULIC ACTUATOR

[75] Inventor: Arthur O. Greer, Los Angeles, Calif.

[73] Assignee: Loud Engineering & Manufacturing, Ontario, Calif.

[21] Appl. No.: 130,306

[22] Filed: Oct. 1, 1993

[51] Int. Cl.[5] ..... F15B 15/26

[52] U.S. Cl. ..... 91/43; 91/45; 91/41; 91/392; 92/1; 92/28

[58] Field of Search ..... 92/27, 28, 14, 24; 91/41, 43, 44, 45, 410, 392

[56] References Cited

U.S. PATENT DOCUMENTS

| | | | |
|---|---|---|---|
| 2,632,425 | 3/1953 | Grover | 92/28 |
| 2,866,315 | 12/1958 | Schakel . | |
| 3,008,454 | 11/1961 | Wilkins | 91/44 |
| 3,180,234 | 4/1965 | Crawley et al. . | |
| 3,203,319 | 8/1965 | Cook | 91/45 |
| 3,463,055 | 8/1969 | Bayles | 91/41 |
| 3,498,182 | 3/1970 | Sheffer et al. . | |
| 3,550,731 | 12/1970 | Roselius et al. | 91/41 |
| 3,584,544 | 7/1986 | Haberman . | |
| 4,699,355 | 10/1987 | Tomlin et al. | 92/24 |
| 4,785,921 | 11/1988 | Hosan et al. | 92/1 |
| 5,050,484 | 9/1991 | Kamimura . | |
| 5,097,748 | 3/1992 | Koch et al. . | |

*Primary Examiner*—Thomas E. Denion
*Attorney, Agent, or Firm*—Denton L. Anderson

[57] ABSTRACT

A method for locking a hydraulic actuator in a predetermined position and a locking hydraulic actuator are provided. The method includes the steps of supplying hydraulic fluid to a forward chamber in the hydraulic actuator, transferring the hydraulic fluid from the forward chamber into a forward moiety of the rearward chamber in the hydraulic actuator, and sealing the hydraulic fluid in the forward moiety of the rearward chamber to accomplish the locking function. Conversely, the actuator lock is released by the application of fluid supply pressure to the rearward variable chamber.

19 Claims, 2 Drawing Sheets

LOCKING HYDRAULIC ACTUATOR

BACKGROUND

The present invention is directed to locking hydraulic actuators and a method for locking a hydraulic actuator in a predetermined position.

Locking hydraulic actuators are commonly used in situations where it is desirable to have a hydraulic actuator which can be secured in a predetermined position without the necessity of maintaining the presence of hydraulic supply pressure. Locking hydraulic actuators are commonly used, for example, in the aircraft industry for lowering or raising landing gear. All prior art locking actuators utilize some sort of internal mechanical locking means. For example, most modern prior art locking actuators utilize a plurality of radially moving locking members which engage into a groove to lock the hydraulic actuator in a predetermined position. These generally contain a shear element physically wedged between the stationary actuator cylinder and the moving piston. Dynamic loads reacted to by relatively small metal to metal contact areas induce large stress concentrations within the locking members and are thus subject to premature wear.

Accordingly, there is a need for a locking hydraulic actuator that is structurally simple, easy and inexpensive to manufacture, durable, and which distribute the locking load both uniformly and symmetrically.

SUMMARY

This invention satisfies this need. The present invention is a method and a locking hydraulic actuator for locking the piston of a hydraulic actuator in a predetermined position without relying on mechanical locking means.

The invention is a method for locking a hydraulic actuator in a predetermined position comprising the steps of (1) supplying hydraulic fluid from a source of hydraulic fluid into a forward chamber disposed in the actuator enclosure, (2) transferring the hydraulic fluid from the forward chamber into a forward moiety of a rearward chamber disposed in the actuator enclosure, and (3) sealing the hydraulic fluid in the forward moiety of the rearward chamber. The forward chamber is defined by the forward end wall, the actuator enclosure, the piston rod, and an intermediate wall positioned between the forward end wall and the piston. The forward moiety of the rearward chamber is defined by the piston, the piston rod, the actuator enclosure, and the intermediate wall.

The hydraulic fluid is sealed in the forward moiety of the rearward chamber by closing an internal valve device. The hydraulic fluid can be transferred from the forward chamber to the forward moiety of the rearward chamber through a cavity in the piston rod, and the valve device can be slidably disposed in the cavity in the piston rod.

The method can further comprise the step of relieving hydraulic pressure in the forward moiety of the rearward chamber created by the thermal expansion of the hydraulic fluid when the actuator is in the locked mode. In this embodiment, thermal expansion of the hydraulic fluid will not result in excessive fluid pressures within the locked chamber.

The invention is also a locking hydraulic actuator comprising a housing member, a piston, a piston seal, a piston rod, an intermediate piston rod seal, a forward piston rod seal, a first port, a second port, a fluid passageway, and a valve device.

The housing member can be a hollow cylinder bounded by a forward end wall and a rearward end wall. The forward end wall and the rearward end wall cooperate with the hollow cylinder to define an actuator enclosure having an interior surface. The housing member has an intermediate wall disposed within the actuator enclosure between the forward end wall and the rearward end wall so as to partition the actuator enclosure into a forward chamber and a rearward chamber. The rearward chamber has a forward moiety and a rearward moiety, and the forward end wall and the intermediate wall each have a central aperture.

The piston has a forward facing surface, a rearward facing surface, and a cross-sectional shape which corresponds to that of the actuator enclosure. The piston is sized and dimensioned to closely conform to the interior surface of the actuator enclosure. Additionally, the piston is slidably disposed within the rearward chamber and partitions the rearward chamber into a forward moiety and a rearward moiety. The size of the forward and rearward moieties change as the piston moves within the actuator enclosure.

The piston seal slidably seals the piston to the interior surface of the actuating enclosure. The piston seal prevents the flow of hydraulic fluid between the piston and the interior surface of the actuator enclosure.

The piston rod is attached to the forward end of the piston and extends away from the piston through the central apertures in the intermediate wall and the forward end wall. The piston rod is attached and is moved by the piston. For example, when sufficient pressure is applied to the rearward facing surface of the piston, the piston moves toward the intermediate wall and the piston rod extends away from the forward end wall. Alternatively, when sufficient pressure is applied to the forward facing surface of the piston, the piston moves toward the rearward end wall and the piston rod is retracted into the hydraulic actuator.

The intermediate piston rod seal slidably seals the piston rod to the central aperture in the intermediate wall and the forward piston rod seal slidably seals the piston rod to the central aperture in the forward end wall. Each of these seals prevents the flow of hydraulic fluid between the piston rod and the central aperture in each respective wall.

The first port is disposed in the housing member to permit fluid communication between the forward chamber and either a source of pressurized hydraulic fluid or an external return sump. Similarly, the second part is disposed in the housing member to permit fluid communication between the rearward moiety of the rearward chamber and either a source of pressurized hydraulic fluid or an external return sump. Basically, the source of pressurized hydraulic fluid can be supplied to the forward chamber through the first port and the source of pressurized hydraulic fluid can be supplied to the rearward moiety of the rearward chamber through the second port.

The fluid passageway connects the forward chamber and the forward moiety of the rearward chamber in fluid communication. Basically, the fluid passageway allows for the flow of hydraulic fluid between the forward chamber and the forward moiety of the rearward chamber.

The valve device is a device disposed in the fluid passageway for alternatively closing and opening the fluid passageway to fluid flow between the forward chamber and the forward moiety of the rearward chamber. When the valve device is open, hydraulic fluid can flow between the forward chamber and the forward moiety of the rearward chamber. Alternatively, when the valve device is closed, the fluid passageway is closed, and hydraulic fluid flow between the forward chamber and the forward moiety of the rearward chamber is blocked. Thus, when the valve device is closed, the forward moiety of the rearward chamber becomes a sealed chamber containing hydraulic fluid. The hydraulic fluid sealed in the forward moiety of the rearward chamber, when the valve device is closed, holds the piston in the locked position.

Preferably, the actuator enclosure of the housing member has a circular cross section and the piston has the shape of a right circular cylinder, to facilitate manufacturing of the actuator and the use of standard seals.

The hydraulic actuator can include a pressure relief valve for releasing hydraulic fluid from the forward moiety of the rearward chamber into the forward chamber when the pressure of the hydraulic fluid in the forward moiety of the rearward chamber reaches a predetermined level. For example, if the valve device is closed, the piston is held in locking position by the hydraulic fluid sealed in the forward moiety of the rearward chamber. However, an increase in temperature causes the hydraulic fluid contained in the forward moiety of the rearward chamber to expand in the forward moiety of the rearward chamber, thereby increasing the pressure in the forward moiety of the rearward chamber. Accordingly, the pressure relief valve is used to release hydraulic fluid into the forward chamber to avoid excessive hydraulic pressure in the forward moiety of the rearward chamber. The pressure relief valve can be located in the intermediate wall.

Alternatively, the thermal expansion of the hydraulic fluid can be compensated for by expanding the forward moiety of the rearward chamber without moving the piston. In this embodiment, the intermediate wall slides to allow the forward moiety of the rearward chamber to expand with the thermal expansion of the hydraulic fluid. In this embodiment, the hydraulic actuator includes an intermediate wall seal and an intermediate restrainer. The intermediate wall has a cross-sectional shape corresponding to that of the actuator enclosure, is sized and dimensioned to closely conform to the interior surface of the actuator enclosure, and is slidably disposed in the actuator enclosure. The intermediate wall seal is used for slidably sealing the intermediate wall to the interior surface and prevents the flow of hydraulic fluid between the intermediate wall and the interior surface.

The intermediate restrainer is used for restricting the sliding of the intermediate wall in the actuator enclosure. The intermediate restrainer restricts the sliding of the intermediate wall and allows the intermediate wall to move only the distance necessary to compensate for the thermal expansion. For example, the intermediate restrainer can be at least one intermediate spring which inhibits the sliding of the intermediate wall. In this embodiment, if the fluid in the forward moiety of the rearward chamber expands, due to a thermal expansion, the intermediate wall slides against the intermediate spring and provides room for the hydraulic fluid in the forward moiety of the rearward chamber to expand without the piston moving.

The fluid passageway connecting the forward chamber and the forward moiety of the rearward chamber in fluid communication can be a cavity disposed in the piston shaft. This cavity can have a forward and rearward passageway extending axially through the piston rod. The forward passageway is positioned so as to always be in fluid communication with the forward chamber and the rearward passageway is positioned so as to always be in fluid communication with the forward moiety of the rearward chamber. In this embodiment, for example, if the pressure of the hydraulic fluid in the forward chamber is greater than the pressure in the forward moiety of the rearward chamber, the hydraulic fluid can flow from the forward chamber into the forward passageway, through the cavity and rearward passageway and into the forward moiety of the rearward chamber. Alternatively, if the hydraulic fluid pressure is greater in the forward moiety of the rearward chamber, the hydraulic fluid can flow from the forward moiety of the rearward chamber into the rearward passageway, through the cavity and forward passageway, and into the forward chamber.

The cavity can have a narrow portion positioned between the forward and rearward passageways and a stem aperture extending through the piston. In this embodiment, the valve device can be a plug disposed in the cavity, having a stem end and an opposed stopper end. The stem end has a cross-sectional shape corresponding to that of the stem aperture, is sized and dimensioned to closely conform to that of the stem aperture, and is slidably disposed in the stem aperture with the stem end extending into the back variable chamber while the opposed stopper end is slidably disposed in the cavity.

The stopper end has a cross-sectional shape corresponding to the cross-sectional shape of the narrow portion of the cavity and the stopper end is sized and dimensioned to snugly fit into the narrow portion to block the flow of hydraulic fluid when the stopper end is inserted into the narrow portion. The plug is sized so that, when the stem end (which extends into the rear cavity) is pushed forward, the stopper end is inserted into the narrow portion of the cavity. The valve device is closed when the stopper end is inserted and pressed into the narrow valve seat portion of the cavity. In this embodiment, a stem seal is used to provide a sliding seal between the stem end of the plug and the stem aperture and a plug spring is disposed in the cavity between the stopper end of the plug and the forward passageway of the cavity. The stem seal inhibits the flow of hydraulic fluid between the stem end and the stem aperture and prevents the flow of hydraulic fluid between the cavity and the rearward chamber. The plug spring is of sufficient resiliency to move the stopper end of a plug out of the narrow portion of the cavity when the forward pushing force on the stem is not present.

Preferably, the cavity has a circular cross section and the plug has the shape of a right circular cylinder. This embodiment is preferred due to manufacturing considerations and seal design considerations.

The hydraulic actuator can further include a spring-loaded locking ram which provides a forward pushing force on the valve stem when the valve stem makes contact with the locking ram as the piston is retracted to its locking position. The locking ram loading spring provides a sufficiently higher valve stem forward closing force then the opposing opening force of the plug spring. When the valve stem is pushed totally forward by the locking ram, the stopper end of the sealing surface of the plug mates with the passageway cavity valve seat and closes the valve. In this embodiment, the locking ram is positioned between the rearward end wall and the piston. The locking ram has a cross-sectional shape corresponding to that of the actuator enclosure, is sized and dimensioned to closely conform to the interior surface of the actuator enclosure, and is slidably disposed in the actuator enclosure.

The locking ram seal slidably seals the locking ram to the interior surface and prevents the flow of hydraulic fluid between the locking ram and the interior surface. The locking ram is position restrained by a mechanical stop against its forward surface such that a preload is maintained on the locking ram loading spring.

The locking ram spring is a spring which is stiffer than the plug spring, and is disposed between the locking ram and the rearward end wall, such that it inhibits the rearward motion of the locking ram when the plug stem makes contact with the locking ram. The cavity housing the locking ram spring can be unpressurized.

In this embodiment, when the stem contacts the locking ram, the stopper end of the plug is inserted into the narrow portion of the cavity, thereby closing the fluid passageway since the locking ram spring is stiffer than the stem spring. If sufficient hydraulic fluid pressure is supplied into the rearward moiety, the locking ram moves towards the rearward end wall, since the piston is locked into position with the valve device being closed. Upon sufficient movement of the locking ram, the stem end of the plug no longer contacts the locking ram, and the stopper end of the plug is forced out of the narrow portion of the cavity by the stem spring. Accordingly, the fluid passageway is opened and the hydraulic actuator is unlocked.

The invention provides a relatively simple way to lock a hydraulic actuator in a predetermined position. The invention is structurally simple, easy and relatively inexpensive to manufacture and provides reliable locking of a hydraulic actuator without the need for complicated moving parts. Since the locking force is provided by a trapped fixed volume of fluid being compressed by external forces acting on the piston rod, the locking force is uniformly distributed within the actuator. Localized high shear stresses induced by mechanical wedge-type locking devices are eliminated.

DRAWINGS

These and other features, aspects and advantages of the present invention will become better understood with reference to the following description, appended claims and accompanying drawings where:

DESCRIPTION

Figure 1:
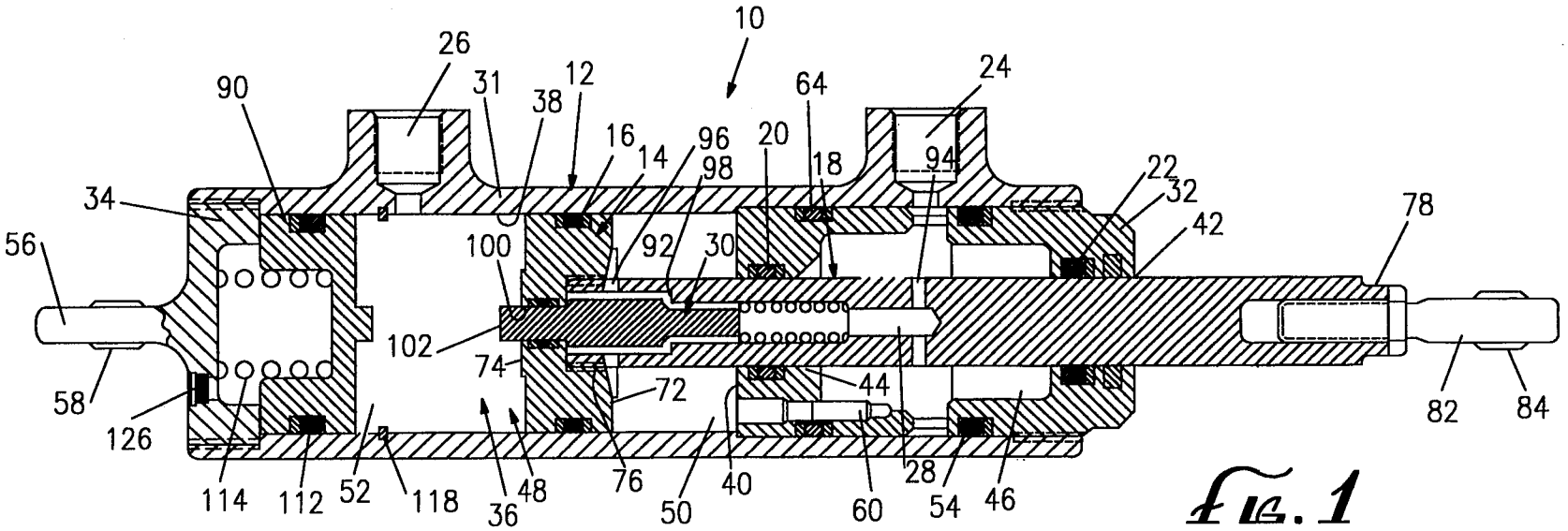
FIG. 1 is a side, cutaway view of a locking hydraulic actuator embodying features of the present invention, the actuator having a pressure relief valve positioned in a stationary intermediate wall.

The following discussion describes in detail one embodiment of the invention and several variations on that embodiment. This discussion should not be construed as limiting the invention to that particular embodiment or to those particular variations. Practitioners skilled in the art will recognize numerous other embodiments and variations as well. For the definition of the complete scope of the invention, the reader is directed to the appended claims.

The word "cylinder" as used in the application means the surface traced by a straight line moving parallel to a fixed straight line and intersecting a fixed curve.

The present invention is a method for locking a hydraulic actuator in a predetermined position and a locking hydraulic actuator 10 useful in the practice of the method. Referring to the drawings, a locking hydraulic actuator 10 according to the present invention comprises: (a) a housing member 12, (b) a piston 14, (c) a piston seal 16, (d) a piston rod 18, (e) an intermediate piston rod seal 20, (f) a forward piston rod seal 22, (g) a first port 24, (h) a second port 26, (i) a fluid passageway 28, and (j) a valve device 30.

The housing member 12 consists of a hollow cylinder 31 bounded by a forward end wall 32 and a rearward end wall 34. The forward end wall 32 and the rearward end wall 34 each cooperate to define an actuator enclosure 36 having an interior surface 38. An intermediate wall 40 is disposed within the actuator enclosure 36 between the forward end wall 32 and the rearward end wall 34. The forward end wall 32 and the intermediate wall 40 each have a central aperture 42 and 44, respectively. The intermediate wall 40 divides the actuator enclosure 36 into a forward chamber 46 and a rearward chamber 48. The rearward chamber 48 is separated by the piston 14 into a forward moiety 50 and a rearward moiety 52.

The central aperture 42 allows the piston rod to extend through the forward end wall 32. Typically, the aperture 42 in the forward end wall 32 has a circular cross-section to facilitate manufacturing and seal compatibility.

The forward end wall 32 and the rearward end wall 34 can be attached to the hollow cylinder 31 by a number of various methods. For example, the opposed ends of the hollow cylinder 31 can have female threads, and each wall can have corresponding male threads inserted into the respective ends of the hollow cylinder 31. Alternatively, the opposed ends of the hollow cylinder 31 can be welded to the respective ends of the hollow cylinder 31. Moreover, either the rearward end wall 34 or the forward end wall 32 can be manufactured as part of the housing member 12. As shown in the drawings, if the forward end wall 32 is attached by threads, a forward end wall seal 54, i.e., an O-ring or other type of seal, must be used to seal the interface between the forward end wall 32 and the hollow cylinder 31.

As shown in the drawing, a rearward actuator attachment element 56 can be attached to the rearward end wall 34. The rearward actuator attachment element 56 provides a linking hole 58 which allows the hydraulic actuator 10 to be attached to a stationary structural element. The rearward actuator attachment element 56 can be welded, threaded, or machined as part of the rearward end wall 34.

The size and dimensions of the housing member 12 can vary according to the task that is required from the hydraulic actuator 10 and the source of pressurized hydraulic fluid. For example, the hydraulic actuator 10 becomes more powerful as the cross-sectional piston cylinder area of the actuator enclosure 36 increases and/or the hydraulic pressure increases. Methods for the sizing of hydraulic actuators 10 is well known by those skilled in the art.

The central aperture 44 allows the piston rod 18 to extend through the intermediate wall 40. Like the aperture 42 in the forward end wall 32, the aperture 44 in the intermediate wall 40 preferably has a circular cross-section to facilitate manufacturing and seal compatibility.

The cross-section of the actuator enclosure 36 can be any shape. However, in most instances, a circular cross-section is the common shape in the industry and is preferred due to manufacturing considerations and seal compatibility. Additionally, the interior surface 38 of the housing member 12 should have a fine finish to provide a good interface for all dynamic seals (i.e., the piston seal 16, the intermediate wall seal 66 and the locking ram seal 112) which slide against the interior surface 38.

The hydraulic actuator 10 can include a relief valve 60 for releasing hydraulic fluid from the forward moiety 50 of the rearward chamber 48 into the forward chamber 46 when the pressure of the hydraulic fluid in the forward moiety 50 of the rearward chamber 48 reaches a predetermined high level. The pressure relief valve 60 prevents the overpressuring of the forward moiety 50 of the rearward chamber 48 from thermal expansion of hydraulic fluid during the periods of time when fluid in the forward moiety of the rearward chamber is trapped therein. The pressure relief valve 60 can be any device capable of releasing the hydraulic fluid from the forward moiety 50 of the rearward chamber 48 into the forward chamber 46 when the pressure of the hydraulic fluid in the forward moiety 50 of the rearward chamber 48 reaches a predetermined limit. The size of the relief valve 60 will vary dependent upon the size and the particular use of the hydraulic actuator 10.

As shown in FIG. 1, this pressure relief valve 60 can be located in the intermediate wall 40. In this embodiment, the relief valve 60 is threaded into an opening in the intermediate wall 40. Thus, when pressure in the forward moiety 50 of the rearward chamber 48 reaches excessive levels, the relief valve 60 opens to allow for the flow of hydraulic fluid through the relief valve 60 into the forward chamber 46 until the pressure in the forward moiety 50 of the rearward chamber 48 falls to allowable levels.

The intermediate wall 40 is rigidly attached to the actuator enclosure 36 in the embodiment in which a relief valve 60 is utilized. An intermediate wall seal 64, i.e., O-ring or other type of seal, can be used to seal between the intermediate wall 40 and the interior surface 38 where necessary.

Figure 2:
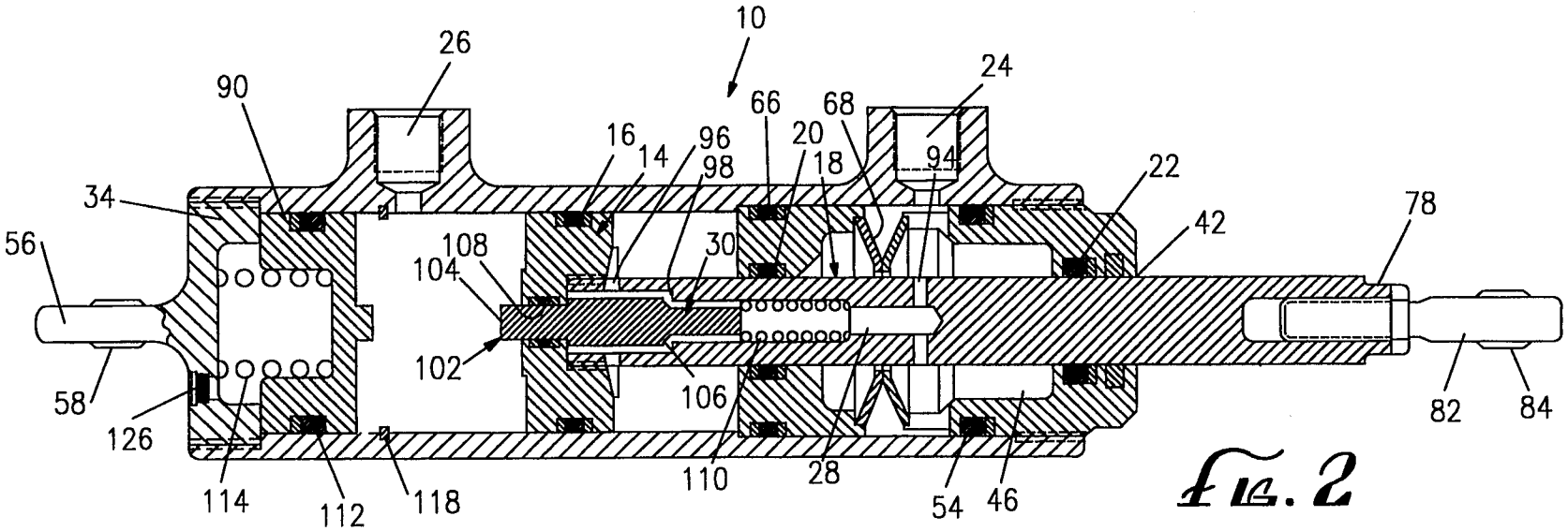
FIG. 2 is a side, cutaway view of a second locking hydraulic actuator embodying features of the present invention with the hydraulic actuator extending, the actuator having no pressure relief valve but, instead, having a forward-only slidable intermediate wall restrained by a stiff resilient element such as a Bellville Spring.
Figure 3:
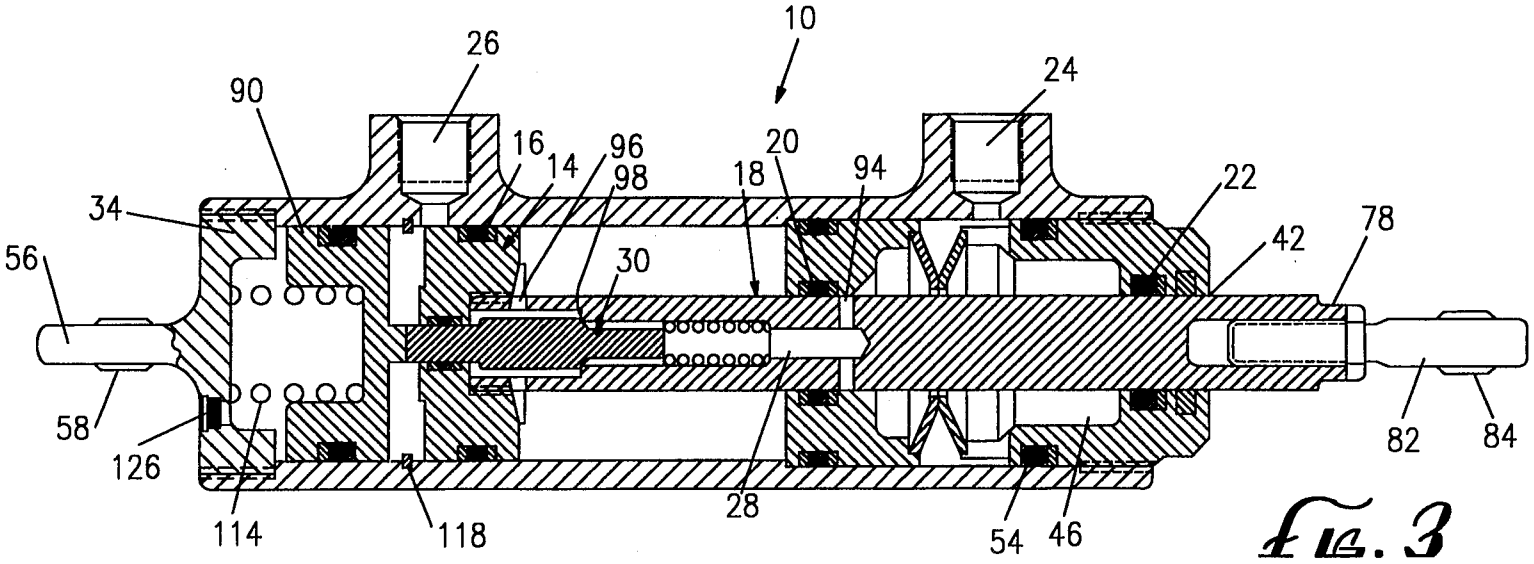
FIG. 3 is a side, cutaway view of the locking hydraulic actuator of FIG. 2 showing the hydraulic actuator locked in a predetermined location.
Figure 4:
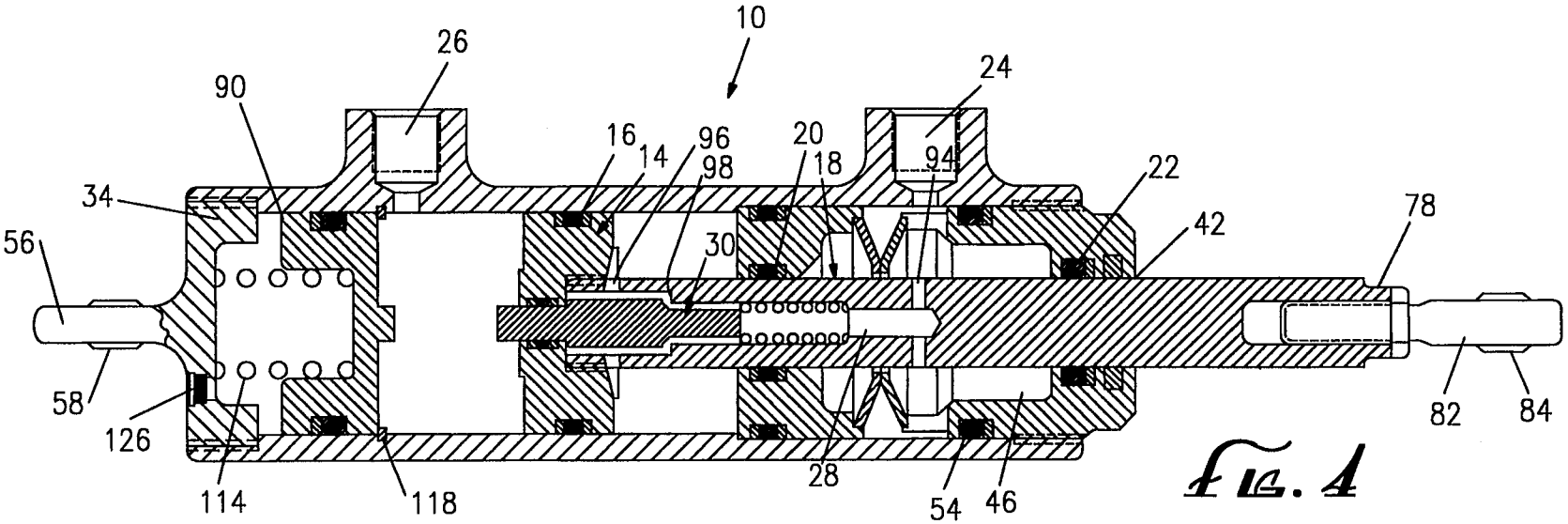
FIG. 4 is a side, cutaway view of the locking hydraulic actuator of FIG. 2 showing the hydraulic actuator in mid-stroke.

Instead of employing a relief valve 60 to relieve excess hydraulic pressure created by thermal expansion within the forward moiety 50 of the rearward chamber 48, the intermediate wall 40 can be slidably disposed in the actuator enclosure 36 with an intermediate wall seal 66 and an intermediate restrainer 68. This embodiment is illustrated in FIGS. 2–4. In this embodiment, the intermediate wall 40 has a cross-sectional shape corresponding to that of the actuator enclosure 36, and the intermediate wall 40 is shaped and dimensioned to closely conform to the interior surface 38 of the actuator enclosure 36. For example, if the interior surface 38 has a circular cross-section, the intermediate wall 40 will have the shape of a right circular cylinder. Typically, this shape is preferred due to manufacturing concerns and seal compatibility.

The intermediate wall seal 66 prevents the flow of hydraulic fluid between the intermediate wall 40 and the interior surface 38. The intermediate wall seal 66 can be any seal capable of slidably sealing the intermediate wall to the interior surface 38 of the actuator enclosure 36. Typically, the intermediate wall seal 66 is an O-ring type seal commonly known by those skilled in the art. The design of the intermediate wall seal 66 depends upon the shape of the interior surface 38. The intermediate wall seal 66 can be made of a rubber material. However, the type of material used may vary according to the hydraulic fluid used and/or to the work environment.

The intermediate restrainer 68 can be any device capable of restricting the sliding of the intermediate wall 40 in the actuator enclosure. The intermediate restrainer 68 restricts the sliding of the intermediate wall 40 but, under certain conditions, allows for thermal expansion of the hydraulic fluid contained in the forward moiety 50 of the rearward chamber 48 by allowing the size of the forward moiety 50 of the rearward chamber 48 to expand. As shown in FIGS. 2–4, the intermediate restrainer 68 can comprise at least one intermediate spring.

The intermediate restrainer 68 can be any type of spring or springs that, when disposed between the intermediate wall 40 and the forward end wall 32, inhibits the sliding of the intermediate wall 40 and does not interfere with the sliding of the piston rod 18. The stiffness of the intermediate restrainer 68 will vary according to the size of the hydraulic actuator 10 and design considerations. As shown in FIGS. 2–4, the intermediate restrainer 68 can be two opposed Bellville springs positioned between the intermediate wall 40 and the forward end wall 32. Alternatively, the intermediate restrainer 68 can be a coil spring sized to fit into the forward chamber 46.

The piston 14 has a cross-sectional shape which corresponds to that of the actuator enclosure 36. The piston 14 is shaped and dimensioned to closely conform to the interior surface 38 of the actuator enclosure 36 so as to be slidably disposed within the actuator enclosure 36. The size and the shape of the piston 14 and the actuator enclosure 36 will vary according to the task to be performed. The potential load-carrying capability of the hydraulic actuator 10 increases as the cross-sectional area of the piston 14 increases. The piston 14 has a forward facing surface 72 and a rearward facing surface 74.

The piston seal 16 can be any seal which slidably seals the piston 14 to the interior surface 38 of the actuator enclosure 36. In most instances, the piston seal 16 is an O-ring type seal commonly known by those skilled in the art. Alternatively, the piston seal 16 can be any other type of seal. The design of the piston seal 16 depends upon the shape of the interior surface 38 and the piston 14. Typically, the piston seal 16 is made of a rubber material. However, the type of material used will vary according to the type of material which will not be adversely affected by the hydraulic fluid or the work environment.

The piston rod 18 has a first end 76 which is attached to the forward facing surface 72 of the piston 14 and an opposed second end 78 which extends away from the housing member 12. The piston rod 18 is attached to the piston 14 and moves with the piston 14. The piston rod 18 extends through the central apertures 42 and 44 in the intermediate wall 40 and forward end wall 32, respectively. The piston rod 18 can be any size or shape which corresponds to the central apertures 42 and 44, respectively, in the intermediate wall 40 and the forward end wall 32. Preferably the piston rod 18 is a right circular cylinder because of ease of manufacture and compatibility with seals. Additionally, this shape is preferred since it provides maximum strength for the cross-sectional area.

The first end 76 of the piston rod 18 is interference fitted into an opening in the piston 14. Alternatively, the first end 76 of the piston rod 18 can be attached to the piston 14 by welds or alternatively by threading the piston rod 18 into the piston 14. Referring to the embodiments shown in the drawings, a front forward piston rod attachment element 82 is attached to the second end 78 of the piston rod 18. The forward piston rod attachment element 82 provides an opening 84 to attach the piston rod 18 of the hydraulic actuator 10 to the object or device which is to be moved or held by the hydraulic actuator 10. As shown in the figures, the second end 78 of the piston rod 18 can have female threads and the forward piston rod attachment element 82 can have corresponding male threads. Alternatively, the forward piston rod attachment element 82 can be attached to the second end 78 of the piston rod 18 by welds or be machined as part of the piston rod 18.

The intermediate piston rod seal 20 can be any seal capable of slidably sealing the piston rod 18 to the aperture 44 in the intermediate wall 40. Similarly, the forward piston rod seal 22 can be any device capable of slidably sealing the piston rod 18 to the aperture 42 in the forward end wall 32. The type of seal utilized will depend upon the size and shape of the intermediate wall aperture 44, the forward end wall aperture 42, and the cross-sectional size and shape of the piston rod 18. In most instances, the intermediate wall aperture 44 and forward end wall aperture 42 have a circular cross-section, and the piston rod 18 has the shape of a right circular cylinder. In this embodiment, the intermediate piston rod seal 44 and the forward piston rod seal 42 will typically be an O-ring type seal commonly known by those skilled in the art. The design of the seals will depend upon the shape of the interior surface 38. Typically, these seals are made of a rubber materials. However, the type of material used for the seal will vary according to the type of material which will not be adversely affected by the hydraulic fluid or the work environment.

The first port 24 allows the hydraulic fluid to flow from a source of pressurized hydraulic fluid into the forward chamber 46 of the hydraulic actuator 10, or conversely for fluid to flow from the forward chamber to an external return sump. The size and shape of the first port 24 can vary and will depend upon the size and shape of the connecting tubes or pipes which are used to connect the source of pressurized hydraulic fluid to the hydraulic actuator 10. As shown in the drawings, the first port 24 comprises an opening extending from the exterior of the housing member 12 into the forward chamber 46 near the forward end wall 32. The first port 24 can have female pipe threads or other types of threads to connect the external source or return sump to the forward chamber 46. In embodiments where the intermediate wall 40 can slide towards the forward end wall 32, the first port 24 must be located so that the movement of the intermediate wall 40 does not affect the flow of hydraulic fluid between the first port 24 and the forward chamber 46.

Similarly, the second port 26 allows the hydraulic fluid to flow into or out of the rearward moiety 52 of the hydraulic actuator 10. The size and shape of the second port 26 can vary and will depend upon the size and shape of the connecting tubes or pipes which are used to connect the source of pressurized hydraulic fluid to the hydraulic actuator 10. As shown in the drawings, the second port 26 comprises an opening extending from the exterior of the housing member 12 into the rearward moiety 52 near locking ram 90 (described below). The second port 26 can have female pipe threads or other types of threads to connect the source of pressurized hydraulic fluid to the rearward moiety 52. In embodiments where a locking ram 90 slides in the actuator enclosure 36, the second port 26 must be located so that the movement of the locking ram 90 does not affect the flow of hydraulic fluid between the second port 26 and the rearward moiety 52.

The fluid passageway 28 can be any passageway which connects the forward chamber 46 and the forward moiety 50 of the rearward chamber 48 in fluid communication. Basically, the fluid passageway 28 allows for the flow of hydraulic fluid between the forward chamber 46 and the forward moiety 50 of the rearward chamber 48. For example, hydraulic fluid will flow from the forward chamber 46 through the fluid passageway 28 into the forward moiety 50 of the rearward chamber 48 if the pressure in the forward chamber 46 is greater than the pressure in the forward moiety 50 of the rearward chamber 48. Alternatively, hydraulic fluid will flow from the forward moiety 50 of the rearward chamber 48 through the fluid passageway 28 into the forward chamber 46 if the pressure in the forward moiety 50 of the rearward chamber 48 is greater than the pressure in the forward chamber 46.

In the embodiment shown in the figures, the fluid passageway 28 is a cavity disposed in the piston rod 18, the passageway 28 having a forward passageway 94 and a rearward passageway 96 extending laterally from the cavity 92 through the piston rod 18. The size of the passageway 28 will vary according to the size of the cross-section of the piston rod 18 and the type of hydraulic fluid utilized. Preferably, the cavity passageway 28 is positioned on the central axis of the piston rod 18 to reduce the effect that the passageway 28 will have on the strength of the piston rod 18. Preferably, the passageway 28 has a circular cross-sectional shape to facilitate manufacturing and seal compatibility.

The forward passageway 94 is positioned so that it will always be in fluid communication with the forward chamber 46 regardless of the position of the piston rod 18 and the intermediate wall 40. Typically, the forward passageway 94 is a hole which extends radially through the piston rod 18. The rearward passageway 96 is positioned so that it will always be in fluid communication with the forward moiety 50 of the rearward chamber 48 regardless of the position of the piston rod 18 and the intermediate wall 40. Similarly, the rearward passageway 96 is a hole which extends through the piston rod 18. The positioning of the forward and rearward passageways 94 and 96 will depend upon the size and shape of the hydraulic actuator 10. The size of the forward and rearward passageways 94 and 96 can vary according to the size of the piston rod 18 and the type of hydraulic fluid utilized.

The passageway 28 can further comprise a narrow valve seat portion 98 positioned between the forward and rearward passageways 94 and 96 and a stem aperture 100 extending through the piston 14.

The valve device 30 can be any device capable of alternately opening and closing the passageway 28. As shown in the drawings, the valve device 30 can comprise a plug 102 having a stem end 104, an opposed stopper end 106, a stem seal 108 and a plug spring 110. The stem end 104 of the plug 102 is slidably disposed in the stem aperture 100 and extends into the rearward moiety 52 of the rearward chamber 48. The stem end 104 has a cross-sectional shape corresponding to that of the stem aperture 100, with the stem end 104 being sized and dimensioned to closely conform to that of the stem aperture 100. The opposed stopper end 106 of the plug has a conical cross-section shape corresponding to the narrow circular portion 98 of the passageway 28. The stopper end 106 is sized and dimensioned to snugly close the narrow annular portion 98 to prevent the flow of hydraulic fluid when the stopper end 106 is inserted into the narrow annular portion 98 of the passageway 28.

The valve device 30 is in the closed position when the stopper end 106 of the plug 102 is snugly mated into the narrow portion 98 of the passageway 28. Alternatively, the valve device 30 is in the open position when the stopper end 106 is not inserted into the narrow annular portion 98 of the passageway 28. The plug 102 is sized so that the stopper end 106 is inserted into the narrow valve seat portion 98 of the passageway 28 when the stem end 104 contacts the locking ram 90.

The size and shape of the plug 102 can vary according to the size and shape of the passageway 28. Preferably, the passageway 28 has a circular cross-sectional shape, and the plug 102 is the shape of a circular cylinder to facilitate manufacturing and seal compatibility.

The stem seal 108 is used for slidably sealing the stem end 104 of the plug to the stem aperture 100. The stem seal 108 is being used to prevent the flow of hydraulic fluid between the passageway 28 into the rearward moiety 52 of the rearward chamber 48. Typically the stem seal 108 is an O-ring type seal commonly known by those skilled in the art. The design of the stem seal 108 depends upon the shape of the stem aperture 100. Typically, the stem seal 108 is made of a rubber materials. However, the type of material used will vary according to the type of material which will not be adversely affected by the hydraulic fluid or the work environment.

The plug spring 110 can be disposed in the cavity between the stopper end 106 of the plug 102 and the forward passageway 94 of the passageway 28. The plug spring 110 can be a coil spring or any type of spring which is of sufficient strength to move the stopper end 106 of the plug 102 away from the narrow valve seat portion 98 of the cavity 92 when the stem end 104 of the plug 102 is not in contact with the locking ram 90. In embodiments with a locking ram 90, the plug spring 110 cannot be as stiff as the locking ram spring 114 (described below) so that when the stem end 104 contacts the locking ram 90, the plug 102 moves instead of the locking ram 90.

The source of pressurized hydraulic fluid (not shown) can be any source which supplies sufficient volume and pressure of hydraulic fluid to the hydraulic actuator as is required by the particular task that needs to be accomplished by the hydraulic actuator. Accordingly, the source of pressurized hydraulic fluid will vary according to the task that needs to be performed.

The type of hydraulic fluid utilized will also vary according to the task to be performed. In most instances, the hydraulic fluid is a hydraulic oil or other type of oil since this type of hydraulic fluid inhibits corrosion of the hydraulic actuator and reduces friction between the moving parts, thereby extending the life of the hydraulic actuator. Alternately, the hydraulic fluid could be any fluid, such as water which is substantially incompressible.

A locking ram 90 can be slidably disposed in the actuator enclosure 36 between the piston 14 and the rearward end wall 34 with a locking ram seal 112 and a locking ram spring 114. In this embodiment, the locking ram 90 has a cross-sectional shape corresponding to that of the actuator enclosure 36, and the locking ram 90 is shaped and dimensioned to closely conform to the interior surface of the actuator enclosure 36. For example, if the interior surface 38 has a circular cross-section, the locking ram 90 will have the shape of a right circular cylinder. Typically, this shape is preferred due to ease of manufacturing and seal compatibility.

The plug 102 is inserted into the narrow portion 108 of the cavity 92 when the stem end 104 contacts the locking ram 90. When the hydraulic actuator 10 is locked, the locking ram 90 provides space for the rearward moiety 52 of the rearward chamber 48 to expand to release the stem end 104 of the plug 102. For example, if sufficient hydraulic forced rearward applied to the rearward moiety 52 of the rearward chamber 48 when the hydraulic actuator 10 is locked, the locking ram 90 forced rearward from the piston 14 allowing the plug spring 110 to push the plug 102 out of the narrow valve seat portion 98 of the passageway 28 and thus unlock the actuator.

The locking ram seal 112 can be any seal capable of slidably sealing the locking ram to the interior surface 38 of the housing member 12. The locking ram seal 112 prevents the flow of hydraulic fluid between the locking ram 90 and the interior surface 38. Typically, the locking ram seal 112 is an O-ring type seal commonly known by those skilled in the art. Alternatively, the seal 112 can be any other type of seal. The design of the seal 112 depends upon the shape of the interior surface 38. Typically, the locking ram seal 112 is made of a rubber material; however, the type of material used will vary according to the type of material which will not be adversely affected by the hydraulic fluid or the work environment.

The locking ram spring 114 can be any device capable of restricting rearward motion of the locking ram 90 in the actuator enclosure 36. The spring restrainer 114 restricts the sliding motion of the locking ram 90 until sufficient hydraulic pressure is supplied in the rearward moiety 52 of the rearward chamber 48. The forward motion of the locking ram 90 may be limited by a mechanical stop 118 which provides a preload to the locking ram spring 114. The rearward motion of the locking ram 90 is limited by the internal protrusion of the rearward end wall 34.

The mechanical stop 118 can be provided by the interior surface 38 of the actuator enclosure 36, having a reduced cross-sectional diameter at a predetermined locking ram stop position. Thus, the locking ram 90 cannot slide past the mechanical stop 118. Alternatively, as shown in FIGS. 2–4, the mechanical stop 118 can be an annular groove disposed on the interior surface 38 of the actuator enclosure 36 with a snap-ring positioned in the annular groove providing the stop 118 at the predetermined limit.

The locking ram spring 114 can be any type of spring or springs that, when disposed between the locking ram 90 and the rearward end wall 34, inhibits the sliding of the locking ram 90. The stiffness of the spring 114 will vary according to the size of the hydraulic actuator 10 and will depend upon design considerations of when the locking ram 90 needs to move to allow for the plug to move to unlock the actuator. The stiffness of the spring 114 and the cross-sectional area of the locking ram 90 determines the hydraulic pressure level required in the rearward moiety 52 of the rearward chamber 48 to move the locking ram 90. The rearward end wall 34 may have a breather opening 126 to maintain atmospheric pressure on the rear surface of the locking ram 90.

In operation, hydraulic fluid is supplied to the first port 24 to move the hydraulic actuator 10 into the predetermined locking position. The hydraulic fluid, which is supplied to the first port 24, flows into the forward chamber 46 of the hydraulic actuator 10 through the fluid passageway 28 into the forward moiety 50 of the rearward chamber 48. If sufficient hydraulic fluid flows into the forward moiety 50 of the rearward chamber 48 and a sufficient pressure is reached, the piston 14 begins to move towards the rearward end wall 34. The hydraulic fluid in the forward moiety 50 of the rearward chamber 48 causes the piston 14 and the accompanying piston rod 18 to retract. When the piston 14 moves to the predetermined locking position, the valve device 30 is closed, sealing the forward moiety 50 of the rearward chamber 48.

The valve device 30 closes when the plug 102 is inserted into the narrow valve seat portion 98 of the passageway 28. When hydraulic fluid is supplied to the first port 24, the hydraulic fluid flows from the forward chamber 46, through the forward passageway 94, through the passageway 28, and out the rearward passageway 96 into the forward moiety 50 of the rearward chamber 48. This hydraulic fluid then forces the piston 14 towards the rearward end wall 34, causing the piston 14 and piston rod 18 to move towards the rearward end wall 34. When the piston 14 moves a sufficient distance, the stem end 104 of the plug 102 contacts the locking ram 90 and causes the stopper end 106 of the plug 102 to be inserted into the narrow valve seat portion 98 of the passageway 28, thereby closing the fluid passageway 28. The hydraulic fluid that is sealed in the forward moiety 50 of the rearward chamber 48 holds the piston 14 and the piston rod 18 at this locked position. If the temperature of the hydraulic fluid increases, excessive hydraulic pressure created by the thermal expansion of the hydraulic fluid is relieved by the relief valve 60 or the intermediate wall 40 moving against the intermediate spring 70 to expand the forward moiety 50 of the rearward chamber 48.

To unlock a locked actuator 10, the locking ram 90 is forced to move rearward towards the rearward wall 34 when sufficient hydraulic pressure is supplied to the rearward moiety of the rearward chamber 48. In this embodiment, once the locking ram 90 moves a prescribed distance, the stem end 104 of the plug 102 no longer contacts the locking ram 90, and the plug spring 110 causes the plug 102 to move out of the narrow valve seat portion 98 of the passageway 38, thereby opening the fluid passageway 28 for hydraulic fluid to flow between the forward moiety 50 of the rearward chamber 48 and the forward chamber 46 and, thereby, unlocking hydraulic actuator 10. Accordingly, the piston 14 moves towards the forward end wall 32, causing hydraulic fluid to flow from the forward moiety 50 of the rearward chamber 48 into the forward chamber 46 and out port 24.

The present invention provides a relatively simple way to lock the piston 14 and piston rod 18 of a hydraulic actuator 10 in a predetermined position. The structure of the locking hydraulic actuator 10 is relatively simple, thus making the hydraulic actuator 10 relatively easy and inexpensive to manufacture. Moreover, hydraulic pressure is used to lock the piston 10 in the predetermined position instead of locking members. Thus, the present invention provides uniformly distributed stresses induced by external unlock induced loads and is not subject to premature wear of the locking members, caused by localized high shear stresses in current typical wedge type locking mechanizations.

EXAMPLE

An example locking hydraulic actuator 10 has a circular cross-section with an internal diameter of 1.5 inches. The locking ram 90 has a surface area of 1.76 square inches. The diameter of the plug stem and 114 is 0.125 inches. The minimum annular clearance between the valve plug 102 and the valve seat 98 is 0.06 inches. The piston rod 18 has four radial holes, spaced apart at 90 degree intervals. Each radial hole has a diameter of about 0.09 inches. The piston rod 18 has a diameter of 0.72 inches. The lateral stroke distance of the piston rod 18 is 1.625 inches. The locking ram spring 114 has a free height of 1.5 inches, an installed height of 1.0 inches and exerts 150 pounds of preload force. The plug spring 110 has a free length of 1.0 inches, an installed length of 0.75 inches and exerts 28 pounds of preload force. The intermediate restrainer 68 are a pair of Bellville springs preloaded for a forced loading on the intermediate wall of greater than 2,600 pounds. The diameter of the piston is 1.5 inches.

This example hydraulic actuator 10 is designed to use a system operating pressure of 1,500 psig with a return line pressure of 25 psig. The operating temperature range of the example actuator is −65° to +165° F. The maximum extension load is 2600 pounds of force. The maximum retraction load is 2,000 pounds of force. The locking mechanism of the hydraulic actuator 10 is designed to hold 1,200 pounds of force tension load, and it is designed to release against about 1,200-pound tension load when the inlet port pressure is between about 75 and 100 psig.

Although the present invention has been described in considerable detail with reference to certain preferred versions, many other versions should be apparent to those skilled in the art. Therefore, the spirit and scope of the appending claims should not necessarily be limited to the description of the preferred versions contained herein.

What is claimed is:

1. A method for locking a hydraulic actuator in a predetermined position, the hydraulic actuator comprising an actuator enclosure defined by a hollow cylinder enclosed by a rearward end wall and an opposed forward end wall, a piston slidably disposed in the actuator enclosure and a piston rod attached to the piston, the method comprising the steps of:

(a) supplying hydraulic fluid from a source of hydraulic fluid into a forward chamber disposed in the actuator enclosure, the forward chamber being defined by the forward end wall, the actuator enclosure, the piston rod and an intermediate wall positioned between the forward end wall and the piston;

(b) transferring the hydraulic fluid from the forward chamber into a forward moiety of a rearward chamber disposed in the actuator enclosure, the forward moiety of the rearward chamber being defined by the piston, the piston rod, the actuator enclosure and the intermediate wall; and (c) sealing the hydraulic fluid in the forward moiety of the rearward chamber.

2. The method of claim 1 further comprising the step of relieving hydraulic pressure in the forward moiety of the rearward chamber created by the thermal expansion of the hydraulic fluid when the forward moiety of the rearward chamber is filled with fluid and sealed.

3. The method of claim 1 wherein the hydraulic fluid is sealed in the forward moiety of the rearward chamber by closing an internal valve device.

4. The method of claim 3 wherein the hydraulic fluid is transferred from the forward chamber to the forward moiety of the rearward chamber through a cavity in the piston rod, the cavity being in fluid communication with the forward chamber and the forward moiety of the rearward chamber, and the valve device is slidably disposed in the cavity of the piston rod.

5. A locking hydraulic actuator comprising:

(a) a housing member comprising of a hollow cylinder bounded by a forward end wall and a rearward end wall, the walls cooperating to define an actuator enclosure having an interior surface, the housing member further having an intermediate wall disposed within the actuator enclosure between the forward end wall and the rearward end wall so as to partition the actuator enclosure into a forward chamber and a rearward chamber, the rearward chamber having a forward moiety and a rearward moiety and both the forward end wall and the intermediate wall having a central aperture;

(b) a piston having a forward facing surface, a rearward facing surface and a cross sectional shape corresponding to that of the actuator enclosure, the piston being shaped and dimensioned to closely conform to the interior surface of the actuator enclosure and being slidably disposed within the forward moiety of the rearward chamber so as to partition the rearward chamber into a forward moiety and a rearward moiety;

(c) a piston seal for slidably sealing the piston to the interior surface of the actuator enclosure;

(d) a piston rod attached to the forward facing surface of the piston, with the piston rod extending away from the piston through the apertures in the intermediate wall and forward end wall;

(e) an intermediate piston rod seal for slidably sealing the piston rod to the aperture in the intermediate wall;

(f) a forward piston rod seal for slidably sealing the piston rod to the aperture in the forward end wall;

(g) a first port disposed in the housing member to permit bi-directional fluid communication between the forward chamber and a source of pressurized hydraulic fluid or a fluid return reservoir sump;

(h) a second port disposed in the housing member to permit bi-directional fluid communication between the rearward moiety of the rearward chamber and a source of pressurized hydraulic fluid or a fluid return reservoir sump;

(i) a fluid passageway connecting the forward chamber and the forward moiety of the rearward chamber in fluid communication with one another; and (j) a valve device disposed in the fluid passageway for alternatively closing and opening the fluid passageway to fluid flow between the forward chamber and the forward moiety of the rearward chamber.

6. The hydraulic actuator of claim 5 wherein the actuator enclosure of the housing member has a circular cross section and the piston having a corresponding shape.

7. The hydraulic actuator of claim 5 further comprising a pressure relief valve for releasing hydraulic fluid from the forward moiety of the rearward chamber into the forward chamber when the pressure of the hydraulic fluid in the forward moiety of the rearward chamber reaches a predetermined level.

8. The hydraulic actuator of claim 7 wherein the pressure relief valve is located in the intermediate wall.

9. The hydraulic actuator of claim 5 wherein the intermediate wall has a cross-sectional shape corresponding to that of the actuator enclosure, the intermediate wall being shaped and dimensioned to closely conform to the interior surface of the actuator enclosure and being slidably disposed in the actuator enclosure, the hydraulic actuator further comprising (a) an intermediate wall seal for slidably sealing the intermediate wall to the interior surface.

10. The hydraulic actuator of claim 9 wherein the intermediate wall is inhibited from sliding towards the forward end wall by at least one intermediate spring disposed between the intermediate wall and the forward end wall.

11. The hydraulic actuator of claim 10 wherein the fluid passageway is a cavity disposed in the piston shaft, the cavity having a forward and rearward passageway extending radially from the cavity through the piston rod, wherein the forward passageway is positioned so as to always be in fluid communication with the forward chamber and the rearward passageway is positioned so as to always be in fluid communication with the forward moiety of the rearward chamber.

12. The hydraulic actuator of claim 11 wherein the cavity further comprises a narrow portion positioned between the forward and rearward passageways and a stem aperture extending through piston, and the valve device comprises:

(a) a plug having a stem end slidably disposed in the stem aperture and extending into the back variable chamber and an opposed stopper end slidably disposed in the cavity, the stem end having a cross-sectional shape corresponding to that of the stem aperture, with the stem end being sized and dimensioned to closely conform to that of the stem aperture, the stopper end having a cross-sectional shape corresponding to the narrow portion of the cavity, the stopper end being sized and dimensioned to fit snugly into the narrow portion to prevent the flow of hydraulic fluid when the stopper end is inserted into the narrow portion;

(b) a stem seal for slidably sealing the stem end of the plug to the stem aperture, wherein the plug is sized so that the stopper end is inserted into the narrow portion when the stem end contacts the rearward abutment; and (c) a plug spring so disposed and being of sufficient strength to move the stopper end of the plug out of the narrow portion when the stem end of the plug is not in contact with the rearward abutment.

13. The hydraulic actuator of claim 12, wherein the cavity has a circular cross-sectional shape and the plug has the shape of a right circular cylinder.

14. The hydraulic actuator of claim 12 further comprising:

(a) a locking ram positioned between the rearward end wall and the piston, having a cross-section shape corresponding to that of the actuator enclosure, the locking ram being shaped and dimensioned to closely conform to the interior surface of the actuator enclosure and being slidably disposed in the actuator enclosure; and (b) a locking ram seal for slidably sealing the locking ram to the interior surface, wherein the stopper end of the plug is inserted into the narrow valve seat portion when the stem end contacts the locking ram.

15. The hydraulic actuator of claim 14 wherein the locking ram is inhibited from sliding rearward by at least one preloaded spring disposed between the locking ram and the rearward end wall for inhibiting the sliding of the locking ram, wherein the locking ram loading spring is stiffer than the plug spring.

16. A locking hydraulic actuator comprising:

(a) a housing member comprising of a hollow cylinder bounded by a forward end wall and a rearward end wall, the walls cooperating to define an actuator enclosure having an interior surface, the housing member further having an intermediate wall disposed within the actuator enclosure between the forward end wall and the rearward end wall so as to partition the actuator enclosure into a forward chamber and a rearward chamber, the rearward chamber having a forward moiety and a rearward moiety and both the forward end wall and the intermediate wall having a central aperture;

(b) a piston having a forward facing surface, a rearward facing surface and a cross sectional shape corresponding to that of the actuator enclosure, the piston being shaped and dimensioned to closely conform to the interior surface of the actuator enclosure and being slidably disposed within the forward moiety of the rearward chamber so as to partition the rearward chamber into a forward moiety and a rearward moiety;

(c) a piston seal for slidably sealing the piston to the interior surface of the actuator enclosure;

(d) a piston rod attached to the forward facing surface of the piston, with the piston rod extending away from the piston through the apertures in the intermediate and forward end walls;

(e) an intermediate piston rod seal for slidably sealing the piston rod to the aperture in the intermediate wall;

(f) a forward piston rod seal for slidably sealing the piston rod to the aperture in the forward end wall;

(g) a first port disposed in the housing to permit bi-directional fluid communication between the forward chamber and a source of pressurized hydraulic fluid or a fluid return reservoir sump;

(h) a second port disposed in the housing to permit bi-directional fluid communication between the rearward moiety of the rearward chamber and a source of pressurized hydraulic fluid or a fluid return reservoir sump;

(i) a fluid passageway connecting the forward chamber and the forward moiety of the rearward chamber in fluid communication with one another, wherein the fluid passageway is an axial cavity disposed in the piston shaft, the cavity having a forward and rearward passageway extending radially from the cavity through the piston rod, wherein the forward passageway is positioned so as to always be in fluid communication with the forward chamber and the rearward passageway is positioned so as to always be in fluid communication with the forward moiety of the rearward chamber, the cavity further comprises a narrow valve seat portion positioned between the forward and rearward passageways and a stem aperture extending through piston; and (j) a valve device disposed in the fluid passageway for alternatively closing and opening the fluid passageway to fluid flow between the forward chamber and the forward moiety of the rearward chamber, the valve device comprising:

(i) a plug having a stem end slidably disposed in the stem aperture and extending into the back variable chamber and an opposed stopper end slidably disposed in the cavity, the stem end having a cross-sectional shape corresponding to that of the stem aperture, with the stem end being sized and dimensioned to closely conform to that of the stem aperture, the stopper end having a cross-sectional shape corresponding to the narrow valve seat portion of the cavity, the stopper end being sized and dimensioned to fit snugly into the narrow valve seat portion to prevent the flow of hydraulic fluid when the stopper end is inserted into the narrow end;

(ii) a stem seal for slidably sealing the stem end of the plug to the stem aperture, wherein the plug is sized so that the stopper end is inserted into the narrow valve seat portion when the stem end contacts the spring-loaded locking ram; and (iii) a plug spring disposed in the cavity between the stopper end of the plug and the forward passageway of the cavity, the spring being of sufficient strength to move the stopper plug out of the narrow valve seat portion when the stem end of the plug is not in contact with the locking ram.

17. The hydraulic actuator of claim 16 further comprising a pressure relief valve for releasing hydraulic fluid from the forward moiety of the rearward chamber into the forward chamber when the pressure of the hydraulic fluid in the forward moiety of the rearward chamber reaches a predetermined level.

18. The hydraulic actuator of claim 16 wherein the intermediate wall has a cross-sectional shape corresponding to that of the actuator enclosure, the intermediate wall being shaped and dimensioned to closely conform to the interior surface of the actuator enclosure and being slidably disposed in the actuator enclosure, the hydraulic actuator further comprising:

(a) an intermediate wall seal for slidably sealing the intermediate wall to the interior surface; and (b) an intermediate restrainer for restricting the sliding of the intermediate wall in the actuator enclosure, the intermediate restrainer comprising at least one intermediate spring disposed between the intermediate wall and the forward end wall for inhibiting the sliding of the intermediate wall.

19. The hydraulic actuator of claim 18 further comprising:

(a) a locking ram positioned between the rearward end wall and the piston, having a cross-section shape corresponding to that of the actuator enclosure, the locking ram being shaped and dimensioned to closely conform to the interior surface of the actuator enclosure and being slidably disposed in the actuator enclosure; and (b) a locking ram seal for slidably sealing the locking ram to the interior surface, wherein the locking ram spring is more resilient than the plug spring;

wherein the stopper end is inserted into the narrow valve seat portion when the stem end contacts the locking ram and, conversely, wherein the stopper end is removed from the narrow valve seat portion when the stem end is not in contact with the locking ram.

* * * * *